United States Patent [19]

Moshnin et al.

[11] 4,006,621

[45] Feb. 8, 1977

[54] PIPE BENDING MACHINE

[76] Inventors: Evgeny Nikolaevich Moshnin, ulitsa Ak. Pavlova, 50, kv. 5; Alexei Fedorovich Nistratov, ulitsa Khlobystova, 16, korpus 1, kv. 48; Stanislav Ivanovich Yanov, Teply Stan, mikroraion 2, korpus 27, kv. 287; Raisa Ivanovna Goncharova, Sharikopodshipnikovskaya ulitsa, 2, kv. 153; Zoya Mikhailovna Frolkina, Sharikopodshipnikovskaya ulitsa, 36/18, kv. 174, all of Moscow, U.S.S.R.

[22] Filed: May 27, 1975

[21] Appl. No.: 580,737

[52] U.S. Cl. ..... 72/151

[51] Int. Cl.[2] ..... B21D 7/04

[58] Field of Search ..... 72/128, 149, 150, 151, 72/298, 305, 310, 319, 388, 458

[56] References Cited

UNITED STATES PATENTS

| | | | |
|---|---|---|---|
| 3,368,377 | 2/1968 | Hirayama et al. | 72/128 |

FOREIGN PATENTS OR APPLICATIONS

| | | | |
|---|---|---|---|
| 163,531 | 6/1955 | Australia | 72/128 |
| 1,215,829 | 11/1958 | France | 72/151 |
| 1,803,006 | 5/1970 | Germany | 72/149 |
| 613,532 | 12/1960 | Italy | 72/310 |
| 456,403 | 11/1936 | United Kingdom | 72/150 |
| 749,159 | 5/1956 | United Kingdom | 72/149 |

*Primary Examiner*—C.W. Lanham
*Assistant Examiner*—E. M. Combs
*Attorney, Agent, or Firm*—Holman & Stern

[57] ABSTRACT

The pipe bending machine of the present invention is adapted for mandrelless pipe bending with the simultaneous compressing of the pipe being bent to avoid thinning of the walls thereof.

The invention can be used to best advantage when applied to bending large-diameter (1000 mm and over) steel pipes.

The machine features the bending mechanism and the longitudinal travelling mechanism so interconnected by means of the members and disks that a braking moment is applied to the bending mechanism and, consequently, pipe upsetting occurs.

9 Claims, 6 Drawing Figures

PIPE BENDING MACHINE

BACKGROUND OF THE INVENTION

The present invention relates to a pipe bending machine and substantially to such one that imparts a bend to the pipe along with an axial compression (upsetting) thereof, whereby the thickness of the pipe walls is not reduced.

This invention can be used to best advantage when applied to bending large-diameter steel pipes (1000 mm and over).

In the prior art, as a rule, a machine for bending large-diameter pipes is used comprising an overhanging bending mechanism provided with a grip and a braking arrangement. The pipe section to be bent is consecutively passed, by virtue of translational motion performed by the pipe under the action of the longitudinal travelling mechanism, through a heating appliance incorporating an electrical inductor, and through a sprayer-type cooling arrangement. Simultaneously with the pipe motion the bending mechanism with the end of the pipe being bent is turned. To provide upsetting of the pipe, the braking arrangement associated with the bending mechanism is used (cf., e.g., USSR Inventor's Certificate No. 183,034 Cl..49h, 18, 1966).

Because the braking arrangement develops an extra force directed oppositely to the pipe longitudinal motion, the power of the longitudinal travelling mechanism must be increased. The force developed by said mechanism is increased accordingly which presents a danger of buckling of the overhanging bending mechanism which holds the pipe being bent by means of a grip.

Attempts to obviate said shortcoming are widely known to have been made by virtue of a considerable increase in the rigidness of the bending mechanism by using a higher weight and larger size thereof.

However, such attempts only partially solve this problem, i.e., the diameter of the pipes being bent cannot exceed 630 mm, whereas in case of a larger pipe size, the weight and overall dimensions of the machine becomes unduly big.

The inventors have the knowledge of another machine for bending metal rods without upsetting, used in manufacturing curved furniture components. In this machine, the bending machine employs a bending mandrel which is rigidly connected with the teeth-carrying disk which is enveloped by a flexible tie member, viz., a chain connected to the longitudinal travelling mechanism (cf., e.g., French Pat. No. 1,215,829 Cl. 21d, 1960).

Notwithstanding the simplicity of its design, said machine is only applicable for small-radius pipe bending because the arm of application of a force to the pipe that is directed lengthwise to the longitudinal axis of the latter exceeds the distance from the point of contact of the chain with said disk to the pivot axis of the bending mechanism. As a result the translational velocity of the pipe portion being bent will inescapably exceed that of the pipe portion directly acted upon by the longitudinal travelling mechanism so that the pipe will be stretched, whereby the pipe walls within the portion being bent will be thinned.

OBJECTS AND SUMMARY OF THE INVENTION

It is therefore a primary and essential object of the present invention to provide a pipe bending machine which would combine the advantageous features of both of the afore-discussed machines without being subjected to disadvantages inherent therein, while the power of the longitudinal travelling mechansim drive would be substantially reduced.

It is another object of the present invention to simplify the design of the machine by dispensing with the braking arrangement.

It is a further object of the present invention to provide a bending mechanism of a light but robust construction.

Further objects and many of the attendant advantages of this invention will become apparent hereinafter from the following detailed description.

It is a specific object of the present invention to provide such a connection between the longitudinal travelling mechanism and the bending mechanism as to do away with the use of any braking arrangement and to avoid disadvantages resulting in thinning the pipe walls on its portion being bent.

According to the invention said object is accomplished due to the fact that in a pipe bending machine proposed herein and featuring its bending mechanism mounted on a shaft and carrying an eccentrically arranged grip with jaws and disks with which tie rods are to interact that connect said mechanism to the longitudinal travelling mechanism, said disks are disposed on both sides of the grip with cheeks and are linked with said shaft which is essentially a crank-shaft. The distance from the longitudinal axis of said shaft to the section of the tie member that contacts the disk exceeds the distance from said longitudinal axis to the middle of the gap clearance in between the contact surfaces of the grip cheeks when the latter are brought together.

The substantial provision of the bending mechanism shaft as a crankshaft enables the bearings of said shaft to be arranged symmetrically with respect to the travelling path of the pipe being bent so as to avoid suspending the bending mechanism from overhead. The fact that the grip jaws are positioned, according to the invention, at a distance smaller than the arm of application of the tie member tension force results in that the linear velocity of the pipe portion being bent is less than the linear velocity of the longitudinal travelling mechanism and, consequently, that of the pipe straight portion, whereby the latter gets upset in the course of bending process. The force that results from pipe upsetting and bending is partially compensated for by the tension force of the tie members so that the drive power of the pipe longitudinal travelling mechanism can be substantially reduced, while symmetrical arrangement of the tie members interconnecting both of said mechanisms provides for favourable conditions for equal distribution of stresses set up in the machine structural components during its operation.

Inasmuch as necessity arises for varying the bending radius in the course of machine changeover, it is expedient that radially arranged slots be provided in the crank webs of said crankshaft for an adjustably traversable holder of the bending mechanism grip to mount on the crankshaft. To vary the bending radius the grip holder is shifted along said slots, thus changing the distance from the grip cheeks to the crankshaft axis and, consequently, the bending radius.

In order that the pipe be preliminarily compressed and the excess mechanical play in the machine mechanisms be eliminated prior to bending process, it is expedient that provision be made in the machine for two adjustably traversable thrust plates adapted to interact with the opposite ends of the pipe to be bent. Provision should likewise be made for a carriage mounted on the machine base by means of ways and made adjustably traversable with respect to the longitudinal travelling mechanism. The carriage is to mount one of said thrust plates, while the other thrust plate can be mounted on the grip holder of the bending mechanism. Such an embodiment of the machine simplifies pipe loading on the machine before bending and its removal upon completion of bending.

To provide rigid coupling of one of the ends of the pipe being bent with the thrust plate mounted on the carriage, it is expedient that provision be made in said thrust plate for a grip with jaws to hold the end of the pipe being bent.

To provide adjustably traversable association of said thrust plate with the carriage, said thrust plate is mounted on the carriage by means of a guideway and a screw which is connected to the thrust plate and is passed through a drive nut mounted in a seat rigidly linked to said carriage.

To provide adjustably traversable connection of the carriage to the pipe longitudinal travelling mechanism and rigid coupling therebetween just before pipe bending process, it is expedient that a double-arm crank with a horizontal pivot axis be provided on the carriage, whereas the longitudinal travelling mechanism be provided with stems having collars, the ends of the double-arm crank being adapted to thrust against said collars of the stems.

To provide association of the longitudinal travelling mechanism with the bending mechanism it is expedient to make use of a crosspiece carrying said stems with collars. The crosspiece can be mounted on the machine by means of a way. Due to such an embodiment of the present invention a considerable simplification of machine construction is attained.

For the sake of convenience in changing the distance from the disk section contacting the tie member to the longitudinal axis of the bending mechanism shaft during machine adjustment, it is expedient that each of the disks of the bending mechanism be made composite. This makes it possible to change the detachable disk components of certain size for the components having another size whenever a necessity for varying the amount of pipe upsetting is involved.

In order to provide constant tension of the tie members it is expedient that each of said disk be provided with a counterbalance weight adapted to establish a torque which permanently tends to turn said disk and, consequently, the bending mechanism round the longitudinal axis of the bending mechanism shaft in such a direction that provides for tension of said tie members.

A substantial advantage of the present invention resides in that drive power of the pipe longitudinal travelling mechanism is reduced at least half as much.

BRIEF DESCRIPTION OF THE DRAWINGS

Given below is a detailed disclosure of a preferable embodiment of the present invention with due reference to the accompanying drawings, wherein.

DETAILED DESCRIPTION OF A PREFERRED EMBODIMENT

Figure 1:
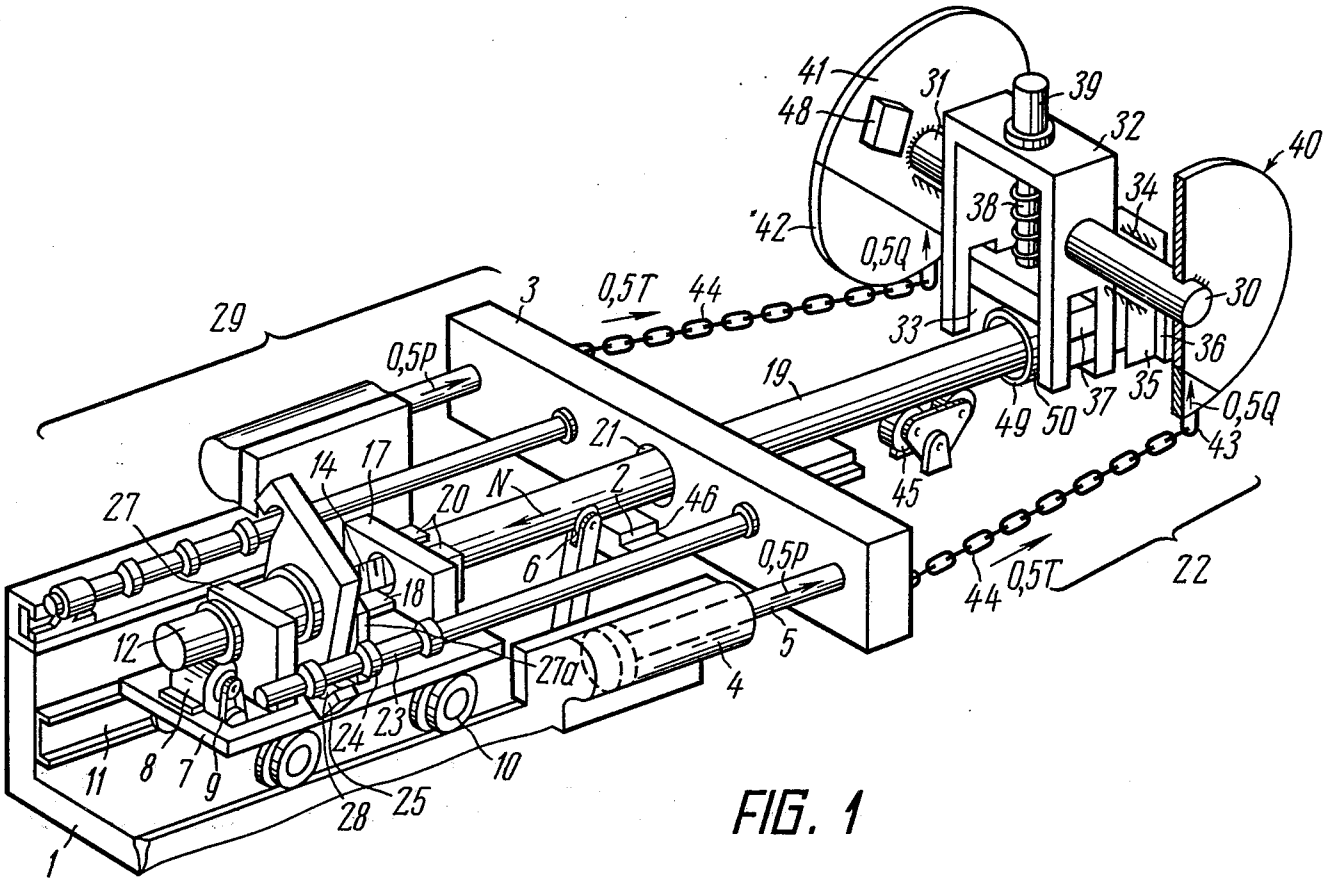
FIG. 1 is a general perspective, partly sectional view of a pipe bending machine, according to the invention.
Figure 2:
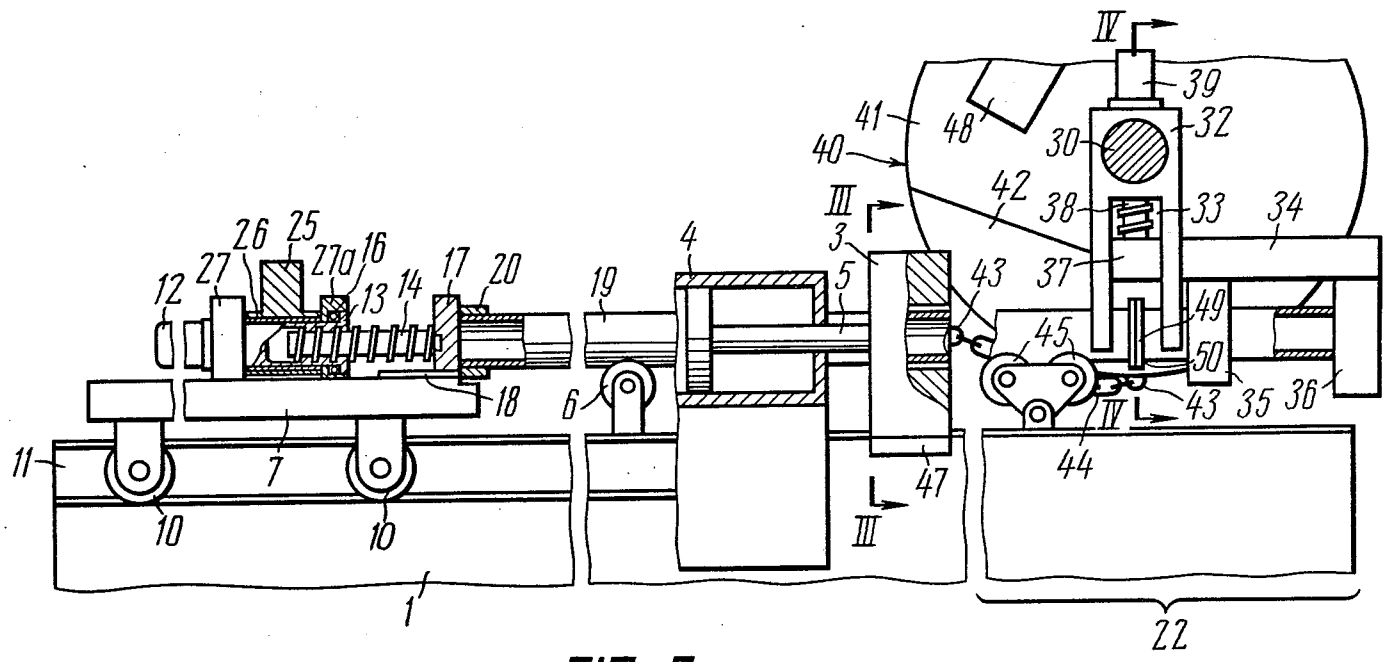
FIG. 2 is a longitudinal section view of FIG. 1.
Figures 3, 4:
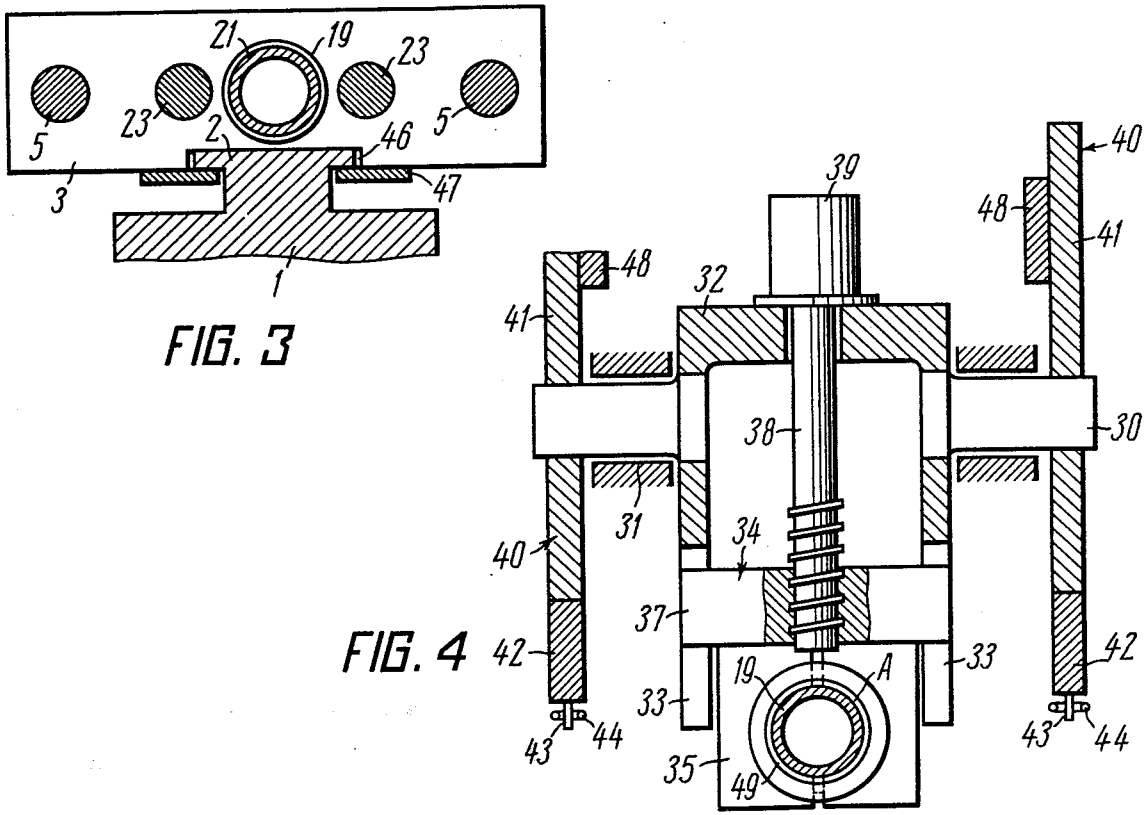
FIG. 3 is a section taken along the line III—III in FIG. 2.
FIG. 4 is a section taken along the line IV—IV in FIG. 2.

Referring to FIGS. 1 to 3, the pipe bending machine of the invention has an oblong base 1 whose middle portion is provided with a T-shaped projection 2 by means of which the base mounts a crosspiece 3 traversable along said T-shaped projection 2 by two power cylinders 4 located on both sides of the base 1. The crosspiece 3 is connected to the movable elements of said cylinders, viz., to rods 5. The base 1 also mounts a roller bed 6 and a self-propelled carriage 7 driven from a motor 8 through a belt drive 9, wheels 10 of said carriage running in ways 11 provided lengthwise the base 1.

The self-propelled carriage 7 is traversable along the ways 11 either towards the crosspiece 3 or away therefrom. The carriage 7 mounts a motor 12 which imparts rotation to a nut 13 through which a screw 14 is passed. The nut 13 is mounted in a seat 15 rigidly linked to the carriage 7. The end of the screw 14 thrusts, through an angular-contact bearing 16, against a movable thrust plate 17 which is mounted on a guide projection 18 of the self-propelled carriage 7 arranged lengthwise to the longitudinal axis of the latter. The thrust plate 17 is adapted to interact with one of the ends of a pipe 19 to be bent which is positioned on said roller bed 6 before bending. The thrust plate 17 carries a grip 20 with a pair of cheeks which is adapted to prevent the pipe 19 from slipping off said plate. A port 21 is made in the middle portion of the crosspiece 3 (middle with respect to the length of the latter, said port being adapted for the pipe being bent to pass through the crosspiece 3 towards a bending mechanism 22 mounted on the base 1 on the other side of the crosspiece. Stems 23 are rigidly locked to the crosspiece 3 on both sides of the port 18 transversely to said crosspiece, said stems having collars 24. The stems 23 are adapted to rigidly connect the self-propelled carriage 7 to the crosspiece 3 just before bending the pipe 19. To provide linkage of the self-propelled carriage 7 to the stems 23, the carriage has a double-arm driven crank having a horizontal pivot axis and mounted on a trunnion 26 which is secured on a stand 27 of the carriage 7 (the drive of the double-arm crank 25 being not shown in the drawings). The ends of the double-arm crank 25 has cylindrical recesses 28 made at a radius that corresponds to the radius of the cylindrical surface of the stems 23, which when said double-arm crank 25 turns its recesses 28 embrace the stems 23, while the ends of said crank keeps the carriage 7 against moving with respect to the stems 23 due to said crank ends thrusting against the collars 24. As a result the self-propelled carriage 7 gets rigidly coupled to the crosspiece 3.

The crosspiece 3 with its power cylinders 4 and the self-propelled carriage 7 form a longitudinal travelling mechanism 29.

The bending mechanism 22 mentioned above, comprises a crankshaft 30 (FIGS. 1, 2, 4, 5) whose ends rests upon adjustably traversable bearings 31 mounted in the base 1; inasmuch as the concept of adjustable movement of said bearings is conventionally known it is not therefore represented in the accompanying drawings. The webs of the crank 32 of the crankshaft 30 have slots 33 arranged radially with respect to the longitudinal axis of said shaft and adapted to mount a holder 34 carrying a grip 35 with a pair of jaws which is arranged eccentrically to the longitudinal axis of the crankshaft 30, and an adjustably traversible thrust plate 36 located past said grip 35.

With the jaws of the grip 35 brought together, their contact surfaces define a gap clearance whose cross-sectional size is less than the outside diameter of the pipe being bent. The holder 34 is secured on the crank 32 by means of projections 37 and a screw 38 loosely fitted through the hole in the cross-arm of the crank 32. The end of the screw 38 is threaded so as to engage the respective threaded hole in the holder 34. The screw 38 is connected to a motor 39 through a gear reducer (not shown) mounted integral with said motor on the corss-arm of the crank 32. When the motor 39 rotates, the holder 34 is free to travel along the radial slots 33 due to the projections 37. The thrust plate 36 is adapted to interact with the end of the pipe 19 to be bent that is secured in the grip 35. The other end of the pipe 19, as has already been said above, interacts with the thrust plate 17.

The crankshaft 30 carries two cylindrical disks 40 each of which is composed of two components, viz., a major stationary portion 41 and a minor detachable portion 42. The disks 40 and the bearings 31 are arranged symmetrically to the crank 32 of the crankshaft 30. The detachable portion 42 of the disk 40 carries a shackle 43 adapted to hold one end of the tie member made essentially as a chain 44 which interconnects the bending mechanism 22 with the longitudinal travelling mechanism 29. Similar shackles 43 are provided on the crosspiece 3 to link it to the other end of each chain 44. The detachable portion 42 of the disk 40 is held to the main (stationary) portion 41 by bolts (not shown) and has the curved outside surface adapted to interact with the chain 44 when the latter is being wound onto the disk 40 by virtue of rotary motion of the bending mechanism 22 occurring during machine operation which will be the subject of further consideration. Provision is made for a set of detachable disk portions 42 different in size so as to readily vary the amount of upsetting of the pipe 19 which depends upon the distance from the peripheral surface of the detachable disk portion 42 to the longitudinal axis of the crankshaft 30.

A possibility of movement of the holder 34 of the grip 35 along the radial slots 33 of the crank 32 in combination with a possibility of replacing the detachable portion 42 of the disk 40 and of displacing the bearings 31, make it possible to bend the pipes 19 of various diameters at various radii within the range the machine is rated for.

The crankshaft 30 along with the holder 34 of the grip 35 and the disks 40 form said bending mechanism 22. The distance *r* (FIG. 5) from the longitudinal axis 00 of the crankshaft 30 to the middle of the gap clearance A (FIG. 4) in between the contact surfaces of the jaws of the grip 35 when the cheeks are brought together, i.e., the centerline of the pipe is less than the distance R from the axis 00 to the section B of contact of each chain 44 with the outside curved surface of the detachable portion 42 of the disk 40. Owing to this when the bending mechanism 22 is turned under the action of the longitudinal travelling mechanism 29 transmitted through the pipe 19 to be bent, the pipe portion being bent travels slower than the longitudinal travelling mechanism 29 does, whereby the pipe gets upset. To take up the reaction force arising during the bending of the pipe 19, the base 1 is provided with the thrust rollers 45.

The crosspiece 3 (FIG. 3) is jointed with the T-shaped projection 2 of the base 1 by means of a slot 46 and plates 47 locked in place on the crosspiece 3 from below by bolts (not shown).

To establish constant tension of the chains 44 the main portion 41 of each of said disks 40 carries a counterbalance weight 48 which creates a torque tending to turn the disk 40 and, consequently, the bending mechanism 22 counterclockwise round the longitudinal axis 00 of the crankshaft 30.

To heat the portion of the pipe 19 (FIG. 1) to be bent a heating appliance 49 is provided which is essentially an electric inductor. To restrict the heating zone a sprayer-type cooling arrangement 50 is provided. Both of said devices are mounted on a movable bedplate (not shown) in the bending mechanism 22. The movable bedplate is fitted in guides (not shown) arranged along the direction of motion of the longitudinal travelling mechanism 29 so as to travel along said guides and has its own drive (not shown) to receive motion therefrom.

When the machine mechanisms are in the initial position, unlike the position shown in FIG. 1 which corresponds to the moment preceding to the bending process, the self-propelled carriage 7 is at a fairly long distance from the crosspiece 3 and is disengaged from the stems 23; the crosspiece 3 is in the position as shown in FIG. 1.

The pipe 19 to be bent is taken from the rack (not shown) by a pipe positioner (not shown) and is laid thereby on the roller table 6 of the machine in between the self-propelled carriage 7 and the crosspiece 3. Then the motor 12 mounted on the carriage 7 is started to impart rotation to the nut 13. Due to rotation of the nut 13 the screw 14 along with the thrust plate 17 traverses along the guide projection 18 until said plate 17 thrust against the nearest end of the pipe 19. Thereupon thrusts drive of the grip 20 mounted on the thrust plate 17 is switched on (the drive of the grip 20 being not shown in the drawings), and the end of the pipe 19 is held in the grip, whereby said end of the pipe 19 is prevented from slipping off the thrust plate 17. Then the motor 8 of the self-propelled carriage 7 is started to traverse the carriage along the T-shaped projection 2 together with the pipe 19 towards the crosspiece 3. The pipe 19 is passed through the port 21 in the crosspiece 3 and the front end of the pipe consecutively passes over the thrust rollers 45, the inoperative heating appliance 49, the inoperative cooling arrangement 50, the open jaws of the grip 35 to rest against the thrust plate 36 of the bending mechanism 22. Next the motor 39 is started, and the holder 34 of the grip 35 is raised for the required height by virtue of rotation of the screw 38. Then the drive of the grip 35 mounted on the holder 34, is switched on, and the other end of the pipe 19 (FIG. 1) is secured with respect to the bending mechanism 22. After this the drive of the double-arm crank 25 mounted on the carriage 7, is switched on to turn said crank clockwise, and the recesses 28 in the double-arm crank 25 move down to engage the stem 23. Then, while appropriately manipulating with the drive motor of the self-propelled carriage 7 one must try to attain such a position of the double-arm crank 25 with respect to the stems 23 that the ends of said crank rest against the collars 24 on the stems 23. Then the motor 12 is started to move the thrust plate 17 towards the crosspiece 3, thus axially compressing the pipe 19 and eliminating the mechanical play in the bending mechanism 22 and the longitudinal travelling mechanism 29.

Figures 5, 6:
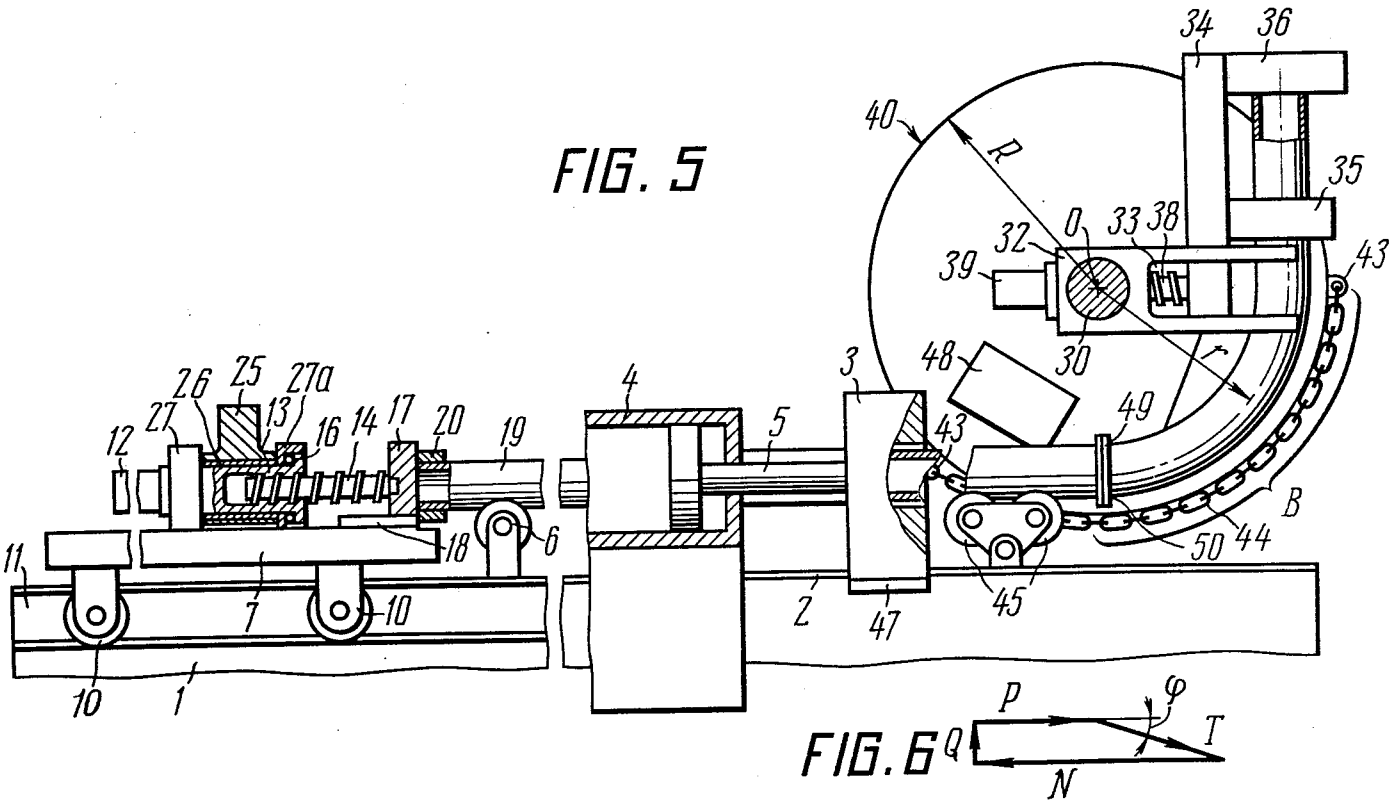
FIG. 5 illustrates the longitudinal travelling mechanism and the bending mechanism while in the position upon completing the bending operation.
FIG. 6 is a diagram of force acting upon the pipe being bent and the machine components.

In this position the heating appliance 49 and the cooling arrangement 50 are displaced somewhat forwards with respect to the longitudinal axis of the crankshaft 30 lengthwise the longitudinal axis of the pipe 19. Then the devices 49 and 50 are thrown into operation and the drive of the movable bedplate whereon they are mounted, is started accordingly. As a result the devices 49 and 50 are displaced backwards until they are postioned under the longitudinal axis of the crankshaft 30. Thereupon the drive of the movable bedplate is switched off, and the power cylinders 4 that impart forward motion to the crosspiece 3 along with the carriage 7 and the pipe 19 towards the bending mechanism 22 are engaged. Because the portion of the pipe 19 to be bent has been preheated and the end of the pipe 19 has been held in the bending mechanism 22, the crank 32 of the crankshaft 30 starts turning along with the holder 34 of the grip 35. The result is that the pipe 19 begins bending, while resting against the thrust rollers 45. Due to a specific joining of the crosspiece 3 with the disks 40 of the bending mechanism 22 disclosed above, the latter mechanism is braked, with the result that the pipe 19 is being upset incessantly in the course of bending. The terminal moment of the bending process is shown in FIG. 5.

The following forces (FIGS. 5 and 6) are exerted upon the pipe 19 and the machine components:

P — total force developed by the power cylinders 4;

T — total tension force of the chains 44 arising from the connection of the disks 40 to the crosspiece 3;

N — reaction force of the pipe 19 developed by virtue of the pressure exerted upon the pipe by the longitudinal travelling mechanism 29;

Q — vertical component of the total tension force of the chains 44 acting in the same direction as the force developed by the power cylinders 4 (since the angle $\phi$ made up by the forces P and T is negligible), on which account the power of said cylinders is managed to be substantially reduced.

Due to the provision of the shaft 30 as a crankshaft the chains 44 are managed to be arranged symmetrically to the pipe 19 and, consequently, the stresses arising in the present pipe bending machine are distributed evenly enough.

To extract the bent pipe 19' from the machine the thrust plate 36 is withdrawn and the jaws of the grip 35 of the bending mechanism 22 are brought apart. When the crosspiece 3 starts travelling the disks 40 begins rotating couterclockwise under the action of the counterbalance weights 48 provided thereon, together with all the rest of the components of the bending mechanism 22. The carriage 7 starts likewise travelling along with the crosspiece 3 towards the bending mechanism 22, thus pushing the pipe 19' out of the machine. Once the bending mechanism 22 has turned to a definite angle depending upon the position of the counterbalance weights 48 on the disks 40, the carriage 7 is disengaged from the crosspiece 3 by turning the double-arm crank 25 counterclockwise, whereupon the motor 8 of the carriage 7 is started again, and the carriage resumes pushing the pipe 19' out of the machine. Then the pipe 19' is picked up by a special mechanism (not shown), whereupon the grip 17 on the carriage 7 releases the pipe 19' and the latter gets completely released from the machine. Then the carriage 7 is withdrawn from the crosspiece 3 to return to the initial position, while the crosspiece 3 is returned into the initial position under the action of the power cylinders 4 and assumes that position under the action of the chains 44 of the bending mechanism 22.

In the present invention, the tie members 44 can be made rigid. The tie members may be embodied as toothed racks engaged with the crosspiece 3 and adapted to interact with a tooth rim provided on the disks 40. It is likewise practicable to make said tie members as rods adapted to interact with the disks 40 through the use of two intermediate mechanisms capable of transforming rotary motion of the disks into translational or some other motion of said rods.

Moreover, the counterbalance weights 48 may be substituted by spring actuators capable of developing constant torque on the crankshaft 30 acting in the direction that steps up tension of the chains 44.

The invention places no limitations upon other embodiments of the units and parts of the machine; however, such embodiments cannot depart from the scope of the invention set forth in the appended claims.

What is claimed is:

1. A pipe bending machine for bending pipe having a longitudinal centerline, comprising: a base; a longitudinal travelling mechanism mounted on said base and adapted to hold the pipe to be bent and move said pipe along the longitudinal axis thereof; a shaft mounted on said base transverse to the direction of motion of said longitudinal travelling mechanism; a grip with jaws, said grip being carried by said shaft and arranged eccentrically to the longitudinal axis of said shaft and adapted to hold the front end of said pipe during said movement of said pipe imparted by said longitudinal travelling mechanism; disks having a radius mounted on said shaft on both sides of said grip with jaws; tie members interconnecting said longitudinal travelling mechanism with said disks, the distance from the longitudinal axis of said shaft to the radius along which one of said tie members contacts one of said disks exceeding the distance from said longitudinal axis of said shaft to the middle of the pipe centerline in between the contact surfaces of said jaws of said grip when the jaws are brought together; said shaft along with said grip with jaws and said disks mounted thereon forming a bending mechanism.

2. The machine as claimed in claim 1, wherein said shaft further comprises a crank-arm on said shaft; crank webs; a cross-arm interconnecting said crank webs to form said crank-arm; each of said crank webs having a slot arranged radially to the longitudinal axis of said shaft; a holder of said grip with jaws incorporated in said bending mechanism and arranged in said crank-arm; projections of said holder located in said slots in said webs of said crank-arm; said holder adapted to traverse along said slots.

3. The machine as claimed in claim 2 further comprising: a carriage mounted on said base on ways, said carriage being adjustably traversable with respect to said longitudinal travelling mechanism; a motor of said carriage for its traversing along said ways; a first adjustably traversable plate mounted on said carriage and adapted to interact with one of the ends of said pipe to be bent; a second adjustably traversable plate mounted on said holder of said grip with jaws of said bending mechanism, adapted to interact with the other end of said pipe to be bent.

4. The machine as claimed in claim 3, comprising a second grip with jaws, said second grip being mounted on said first adjustably traversable plate located on said carriage, said second grip with jaws being adapted to hold one of said ends of said pipe to be bent.

5. The machine as claimed in claim 3, comprising a guide projection on said carriage, said projection mounting said first adjustably traversable plate; a seat rigidly connected to said carriage; a nut rotatably mounted in said seat; a motor mounted on said carriage and associated with said nut to impart rotation thereto; a screw passed through said nut and interconnected with said first adjustably traversable plate; with said nut rotated, said screw together with said first adjustably traversable plate travels along said guide projection.

6. The machine as claimed in claim 3, comprising a double-arm crank with a horizontal pivot axis, said crank being mounted on said carriage; stems with collars, provided on said longitudinal travelling mechanism; the ends of said double-arm crank being adapted to thrust against said collars of said stems, whereby said carriage becomes rigidly coupled with said stems.

7. The machine as claimed in claim 6, comprising a crosspiece mounted on the base by means of a guide projection and carrying said stems with said collars; said crosspiece making part of said connection between said longitudinal travelling mechanism and said bending mechanism.

8. The machine as claimed in claim 1, comprising a counterbalance weight on each of said disks adapted to maintain a torque tending permanently to rotate said disk and, consequently, said bending mechanism about the longitudinal axis of said shaft of said mechanism in such a direction that provides for a constant tension on said tie members.

9. The machine as claimed in claim 1, wherein each disk comprises a first portion and a second portion, said first portion being secured to said shaft and said second portion being detachable from said first portion, to enable said radius along which one of said tie members contacts one of said disks to be varied depending on the size of the pipe to be bent.

* * * * *